United States Patent [19]

Sweet

[11] 4,071,941

[45] Feb. 7, 1978

[54] METHOD FOR ASSEMBLYING IMPROVED TRUSS JOIST

[76] Inventor: LaVern E. Sweet, 6561 Arthur St., Chino, Calif. 91710

[21] Appl. No.: 814,258

[22] Filed: July 11, 1977

Related U.S. Application Data

[63] Continuation-in-part of Ser. No. 703,040, July 6, 1976, abandoned.

[51] Int. Cl.[2] ..... E04C 3/292; B23Q 3/00

[52] U.S. Cl. ..... 29/468; 52/693

[58] Field of Search ..... 29/468, 467, 466, 465, 29/464, 469, 526, 200 P; 81/3 R; 52/262, 289, 693, 753

[56] References Cited

U.S. PATENT DOCUMENTS

| | | | |
|---|---|---|---|
| 1,109,094 | 9/1914 | Weckbaugh | 29/468 |
| 3,570,204 | 3/1971 | Birkemier | 52/289 |

*Primary Examiner*—Milton S. Mehr

*Attorney, Agent, or Firm*—Knobbe, Martens, Olson, Hubbard & Bear

[57] ABSTRACT

An improved method of assemblying truss joist comprising locating and aligning apertures in chord and web members by inserting a tapered pin followed by driving out of the tapered pin and replacing it with a knurled or enlarged pin is disclosed.

5 Claims, 7 Drawing Figures

FIG. 1.
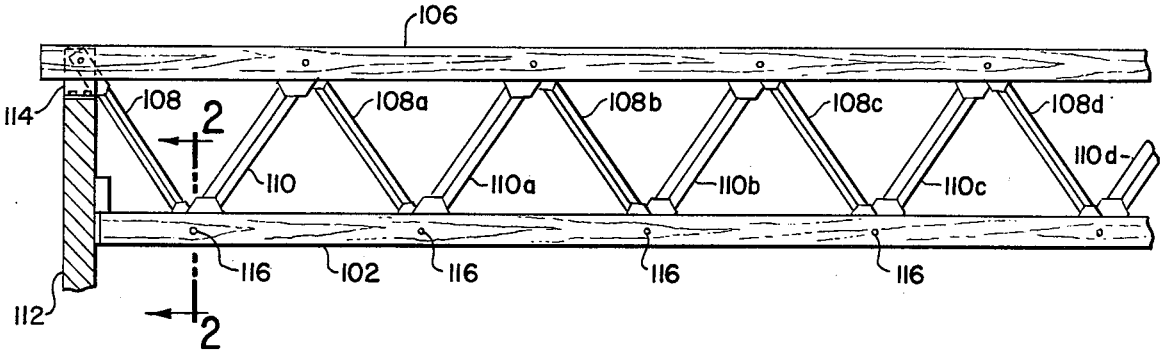
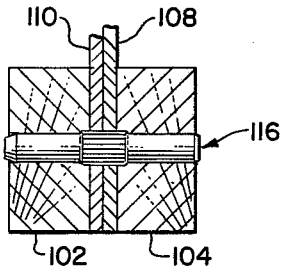
FIG. 2.
FIG. 3.
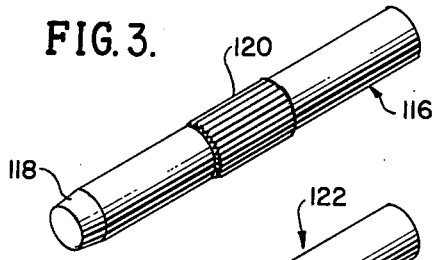
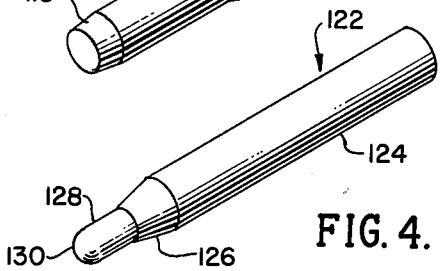
FIG. 4.
FIG. 5.
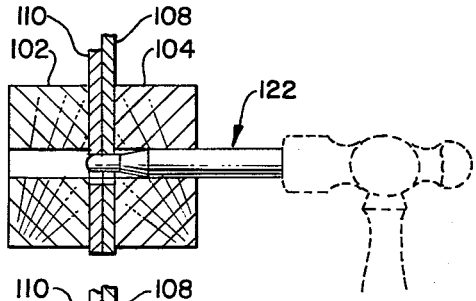
FIG. 6.
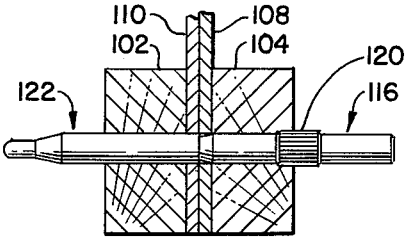
FIG. 7.
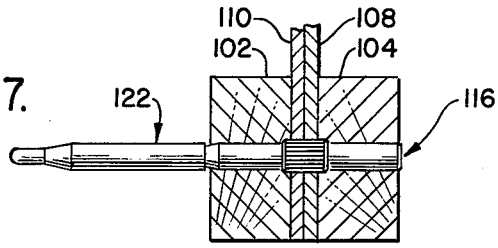

METHOD FOR ASSEMBLYING IMPROVED TRUSS JOIST

RELATED PATENT APPLICATION

This is a continuation-in-part of Ser. No. 703,040, filed July 6, 1976, abandoned.

This invention relates to building constructions, specifically to standard building structures of the type known as trus joists and to an improved method for assemblying the same.

Truss joists of various constructions are well known in the art. For Example, U.S. Pat. No. 3,268,251 and U.S. Pat. No. 3,570,204 illustrate two examples of the type of construction.

The advantages of this type of structure truss joist, is that a relatively lightweight structure provides rigid high-strength horizontal support structure. In the general method for assemblying truss joists, overlapping ends of webs which are apertured are placed in a wooden chord member which has been drilled. It is necessary to align the aperture in the wooden chord with the apertures in the two web members. Conventionally, this is done by driving at a pin of the full size to align all of the elements and then withdrawing the pin. This results in frequent rupturing of the wood immediately around the drilled aperture in the chord and often to distortion of the apertured end of the webs. Withdrawal of the guide and alignment pin results in the misalignment of the ends of the webs as compared with the aperture through the chord. When the structural pin is driven through, even a slight misalignment results in rupturing of the wood in the vicinity of the aperture and often in the distortion of the misaligned end of the web. This results in weakening of the chord at the critical joining point between the web elements and the chord. The overall result is a weakened structural member.

One of the features of this invention is that by a modified method, significantly improved results and stronger truss joists can be assembled with greater efficiency and economy.

In general terms, the invention comprises driving a tapered guide pin through the apertures in the chord and the web ends and then driving out the tapered aligning pin with a knurled or enlarged structural pin, the apertures in the chord and the web staying in alignment as the pins are driven through.

This process and various other characteristics and advantages are illustrated in the drawings.

FIG. 1 is a side view depicting part of the exemplary truss joist, of the type shown in U.S. Pat. No. 3,570,204, for example.

FIG. 2 is a cross-sectional view of the chord and the overlapping ends of two web elements.

FIG. 3 is a perspective view of a knurled structural pin of the type which permanently secures the truss joist elements together.

FIG. 4 is a perspective of one form of a tapered guide pin used for aligning the apertures in the chord and web elements.

FIG. 5 is a schematic drawing showing the inner section of two web elements and a chord element and depicting the first step in the process of this invention, driving in the guide pin to align the apertures in the respective elements.

FIG. 6 depicts the same cross-sectional view shown in FIG. 5 and the next step in the process, comprising driving out the guide pin with the structural pin.

FIG. 7 shows the completed process with the structural pin in place securing the truss joist joint between the web elements and the chord together.

Referring to FIG. 1 and FIG. 2, one of various forms of typical truss joists is depicted. In the truss joist depicted in FIGS. 1 and 2, two parallel boards, such as 2×4's 102 and 104, depicted in FIG. 2, form the bottom chord and a similar pair of boards, one of which is shown at 106 forms the upper chord. A plurality of web elements 108, 108*a*, 108*b*, 108*c* and 108*d* and 110 and 110*a*, 110*b*, 110*c* and 110*d* form a web structure which extends diagonally between the two chord members. One end of the truss joist is supported on a wall 112 by a suitable bracket or other means indicated generally at 114.

The web members are secured to the respective chord members by a plurality of pins indicated at 116 in FIGS. 1 and 2, like pins being used throughout the structure.

One form of the pin 116 is shown in FIG. 3 in which the generally cylindrical shape of the pin having a very slightly tapered leading edge 118 and knurled or raised center portion 120 are shown.

In the completed intersection of the chord members at the web members shown in FIG. 2, the knurled section 120, or an equivalent raised section, fits very tightly in the apertures in the metal webs 108 and 110 and less tightly in the wooden chord members 102 and 104, thus preventing relative movement of the web members and securing the web members tightly in the chord members. It is not necessary that the pin 116 be of the kind depicted in FIG. 3, however, any generally cylindrical pin would be suitable. For example, pins of the type shown in U.S. Pat. No. 3,268,251 would, for purposes of this invention, be the full equivalent; however, the pins depicted in this invention and in U.S. Pat. No. 3,570,204 have very dramatic and significant improving effects on the quality of the truss joist structure. Since these are the subject of the aforementioned U.S. Pat. No. 3,570,204, they wll not be discussed in detail here.

A guide pin 122 of the type used in this invention is depicted in FIG. 4. A number of types of pins could be used but this has been found to be advantageous. In the type of guide pin depicted in FIG. 4, the pin consists primarily of a generally cylindrical portion 124, a frustoconical tapering portion 126, tapering down to a smaller generally cylindrical but slightly tapering section 128 which then tapers into a round end 130. Another form of the pin could simply be a generally tapered end. Other forms may also be used, so long as one end of the pin is tapered so as to provide guidance and alignment of the apertures in the chord and the webs.

The first step in the inventive process is to place two or more web elements having overlapping ends with apertures therein in a slot or space between chord element through which an aperture has been formed such that the apertures in the web end and the chord elements are generally in alignment. The next step is to drive a guide pin 122 through the generally aligned apertures and web elements and the chord elements, as shown in FIG. 5 to align the web and chord element apertures.

The next step is to drive the tapered guide pit through the chord element and out the other side using the permanent structural truss joist pin 116, as shown in FIG.

6. In this manner, the elements are kept in alignment during the exchange of the guide pin and the permanent strutural pin, the final structure being shown in FIG. 7.

By this method, the apertures in the web and the chord elements are gently forced into complete alignment with the guide pin 122 which is slightly smaller in diameter or equal to the diameter of the structure pin but does not include an enlarged section. Once the alignment has been accomplished, alignment is maintained by driving the structural pin directly behind the guide pin, making it impossible for the apertures and the various elements to become misaligned.

The foregoing procedure avoids any rupturing of the wood surrounding the aperture through the chord elements 102 and 104. Likewise, the apertures through the ends of the overlapping web elements 108 and 110 are in no way deformed. Consequently, the total strength of the truss joists is retained and, in addition, each joint between the web element and the chord element is tight. This is extremely important in truss joists which are used to support a floor since a loose joint in the truss joist tends to cause a clicking or squeaking sound as a person walks over the floor.

It will be understood that the particular type of truss joist selected for illustrating the invention is merely exemplary and that many types of truss joists may be used. In one of the more common types of truss joist, a single chord element is simply slotted in the center with an aperture drilled perpendicularly to the slot so that the web elements extend down into the slot and a pin is driven through the aperture and the chord element at the ends of the web elements. The invention does not lie in a particular type of truss joist but in the method of assembing truss joists.

Quite obviously, there are many variations in the particular shapes and sizes of particular guide pins and structural pins which may be used without departing the least from the concept or the practice of the invention as taught in the exemplary embodiment described hereinbefore.

I claim:

1. The method of assemblying an improved truss joist comprising the steps of:

first, placing in general alignment apertures in the ends of at least two web elements and an aperture in at least one chord element;

directly driving through all of the aforesaid apertures a cylindrical guide pin with a tapered guiding end and having a flat end opposite its tapered guide end to already force said apertures into complete alignment, the cylindrical portion of said guide pin having approximately the same diameter as that of said apertures;

thereafter, placing a structural pin in a flat, unattached, abutting relationship with the flat untapered end of said guide pin, said structural pin having approximately the same general diameter as that of said apertures and as that of the cylindrical portion of said guide pin; and subsequently, indirectly driving the guide pin completely out of the aforesaid apertures to that said unattached guide pin moves free of said apertures and said structural pin by directly driving through the aforesaid apertures behind the guide pin said flatly abutting structural pin for permanently securing the web elements to the chord element, the equality of the respective diameters of said apertures, said guide pin, and said structural pin serving to maintain the complete alignment of said apertures during the fastening operation without damaging said web elements or said chord element, and without deforming said apertures.

2. The process of claim 1 wherein the structural pin has a raised section proximate the central portion thereof for securing the ends of the web element permanently together in relatively non-pivotal relationship.

3. In a method for assemblying truss joists wherein a structural pin is driven through an aperture in a chord and through apertures in the ends of overlapping web elements, the improvement comprising first aligning said apertures with a tapered end cylindrical guide pin having a flat end opposite its tapered guide end directly driven into said aperture, then placing a structural pin in a flat, unattached, abutting relationship to said guide pin, the respective diameters of said apertures, said guide pin, and said structural pin being approximately equal, and thereafter driving the structural pin behind the guide pin to thereby replace the guide pin and indirectly drive the guide pin completely out of said apertures so that said unattached guide pin moves free of said apertures and said structural pin while retaining said apertures in complete alignment without damaging said chord or said web elements, or deforming said apertures, during the fastening operation.

4. The method of assemblying an improved truss joist comprising the steps of:

first, placing in general alignment apertures in the ends of at least two web elements and an aperture in at least one chord element;

directly driving through all of the aforesaid apertures a cylindrical guide pin with a tapered guiding end to thereby force said apertures into complete alignment, the cylindrical portion of said guide pin having approximately the same diameter as that of said apertures;

thereafter, placing a structural pin, guided independently of said guide pin, behind the untapered end of said guide pin, said structural pin having approximately the same general diameter as that of said apertures and as that of said guide pin; and subsequently, indirectly driving the guide pin completely out of the aforesaid apertures by driving through the aforesaid apertures directly behind the guide pin said independently guided structural pin for permanently securing the web elements together, the equality of the respective diameters of said apertures, said guide pin, and said structural pin serving to maintain the complete alignment of said apertures during the fastening operation without damaging said web elements or said chord element, and without deforming said apertures.

5. The method of claim 4 in which said structural pin is a solid pin having a tapered end.

* * * * *

Disclaimer 4,071,941.—*La Vern E. Sweet*, Chino, Calif. METHOD FOR ASSEMBLING IMPROVED TRUSS JOIST. Patent dated Feb. 7, 1978. Disclaimer filed Apr. 5, 1978, by the inventor.

The term subsequent to February 7, 1995 has been disclaimed.

[*Official Gazette June 6, 1978.*]